US005646719A

United States Patent [19]

Stephany

[11] Patent Number: 5,646,719

[45] Date of Patent: Jul. 8, 1997

[54] CLEANER-BRUSH HAVING A FIBERLESS SEGMENT

[75] Inventor: Timothy J. Stephany, Williamson, N.Y.

[73] Assignee: Xerox Corporation, Stamford, Conn.

[21] Appl. No.: 541,362

[22] Filed: Oct. 10, 1995

[51] Int. Cl.[6] ..... G03G 21/00

[52] U.S. Cl. ..... 399/287; 399/9

[58] Field of Search ..... 355/301, 302.3, 355/296, 215, 203, 204, 205–209, 297, 298; 15/256.5, 256.51, 256.52

[56] References Cited

U.S. PATENT DOCUMENTS

| | | | |
|---|---|---|---|
| 4,054,381 | 10/1977 | Bernhard | 355/215 |
| 4,449,241 | 5/1984 | Nakayama | 118/699 |
| 4,571,066 | 2/1986 | Morrison | 15/256.5 X |
| 4,768,062 | 8/1988 | Tanzawa et al. | 15/256.51 X |
| 4,835,807 | 6/1989 | Swift | 15/256.5 X |
| 4,878,093 | 10/1989 | Edmunds | 355/296 |
| 5,083,169 | 1/1992 | Usui et al. | 355/296 |
| 5,237,377 | 8/1993 | Harada et al. | 355/301 |
| 5,257,079 | 10/1993 | Lange et al. | 355/303 |

*Primary Examiner*—Thu Anh Dang
*Attorney, Agent, or Firm*—T. L. Fair

[57] ABSTRACT

A method and apparatus for cleaning residual particles from a surface that includes a cleaning brush with a fiberless segment and a fiber segment. These two segments enable the cleaning brush to both clean the surface with the fiber segment by rotating the cleaning brush and prevent cleaning when the fiberless segment is stopped, during development, in the home position. The fiberless segment, in the home position, enables image on image development, without retraction of the cleaner brush, by positioning the fiberless segment of the brush directly opposite to the surface where the image has being developed by image on image.

9 Claims, 2 Drawing Sheets

CLEANER-BRUSH HAVING A FIBERLESS SEGMENT

BACKGROUND OF THE INVENTION

This invention relates generally to a cleaning apparatus, and more particularly, concerns an apparatus for disabling cleaning without retraction.

In the image on image, multi-pass color development process, four layers of color toner (black, cyan, yellow and magenta) are developed onto the photoreceptor before transfer to paper. A separate cycle of the photoreceptor is required to accomplish the development of each color toner layer. To avoid disturbance of these images as the color toner layers are being developed, the cleaning elements must be disengaged from the photoreceptor surface until after the four toner layers have been developed and transferred to paper. After the toner image has been transferred to the paper the cleaning elements must be re-engaged to the photoreceptor to clean any residual toner which failed to transfer.

Several copiers presently use the multi-pass process before a single transfer step. The Konica 9028 machine uses a blade cleaner which is retracted from the photoreceptor drum while the color images are being developed. The Panasonic FP-C1 machine uses a single electrostatic brush cleaner which is retracted by a cam from the drum photoreceptor. The Sharp CX7500 machine uses an intermediate belt and a dual blade cleaner which is retracted from the photoreceptor belt by a solenoid during color image development. The primary, high load, blade is also retracted when the photoreceptor seam passes under the blade to avoid a motion quality disturbance. All of these methods involve movement of the cleaning device into and out of contact with the photoreceptor.

The following disclosures may be relevant to various aspects of the present invention and may be briefly summarized as follows:

U.S. Pat. No. 5,257,079 to Lange et al. discloses a cleaning brush electrically biased with an alternating current and removes discharged particles from an imaging surface. The particles on the imaging surface are discharged by a corona generating device. A second cleaning device including an insulative brush, a conductive brush or a blade, located upstream of the the first mentioned brush, in the direction of movement of the imaging surface, further removes redeposited particles therefrom.

U.S. Pat. No. 4,878,093 to Edmunds discloses a cleaning housing and supports in cleaning relationship a closely spaced combination of an upstream brush roll cleaner and an adjacent downstream foam or porometric roll cleaner. Subsequent to release of toner from the surface, toner is carried away from the charge retentive surface on the fibers of the brush or the surface of the foam rolls. A blower creates a directed air flow for the removal of toner from the cleaning rolls. Mechanical toner removal devices may also be used to release toner from the roll surfaces. The brush roll cleaner provides a primary cleaning function, while the foam roll cleaner provides a secondary cleaning function as a back up to the brush roll cleaner and an abrading function for the removal of film buildup on the charge retentive surface.

SUMMARY OF INVENTION

Briefly stated, and in accordance with one aspect of the present invention, there is provided a method for cleaning particles from a surface using a cleaner brush, capable of motion, having a home position, the home position of the cleaner brush preventing cleaning contact between the cleaner brush and the imaging surface, comprising: positioning the cleaner brush in the home position to prevent contact between the cleaner brush and the imaging surface during developing; developing a multi-layered image on the surface; transferring the multi-layered image from the surface to a media; and restarting movement of the cleaner brush to remove residual particles from the surface.

Pursuant to another aspect of the present invention, there is provided an apparatus for removing particles from a surface, comprising: means for developing a multi-layer image on the surface; means for transferring the multi-layer image from the surface to a media; means for cleaning residual particles having a first segment that avoids contact with the surface to prevent removal of the particles from the surface during development of the multi-layer image and a second segment that contacts the surface after transfer of the multi-layer image; means for positioning the first segment adjacent to the surface during development of the multi-layer image on the surface comprising a home position; and means for moving the cleaning means to enable the second segment to remove particles from the surface after transferring the multi-layer image to the media.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 2:
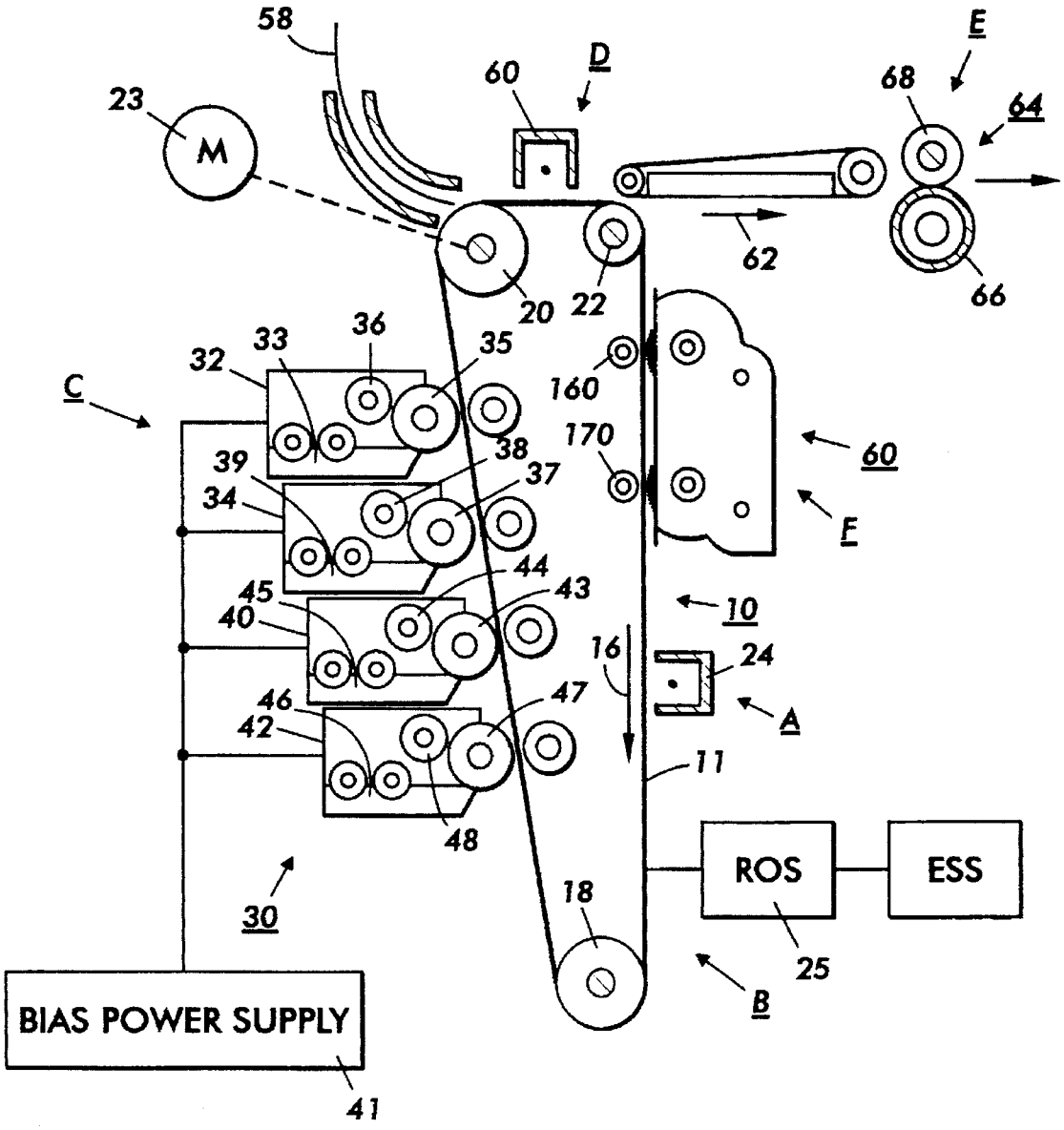
FIG. 2 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 2 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station F and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 2, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

The multi-pass (e.g. four passes for four colors) single transfer process requires that the cleaner function be disabled, while different color toners are sequentially built up on the photoreceptor. Mid-volume family (i.e. MVF) machine applications normally require a dual electrostatic brush (ESB) cleaner to meet motion quality (MQ) goals that a retracting blade cleaner cannot meet. Also, a retracting dirt problem (at 3 o'clock) occurs with a blade cleaner that is eliminated in a dual ESB cleaner. (i.e. In a 3 o'clock doctor blade cleaner, the toner build up that occurs at the cleaning edge falls downward when the blade is retracted. This toner build up does not occur with an ESB cleaner.)

Figure 1:
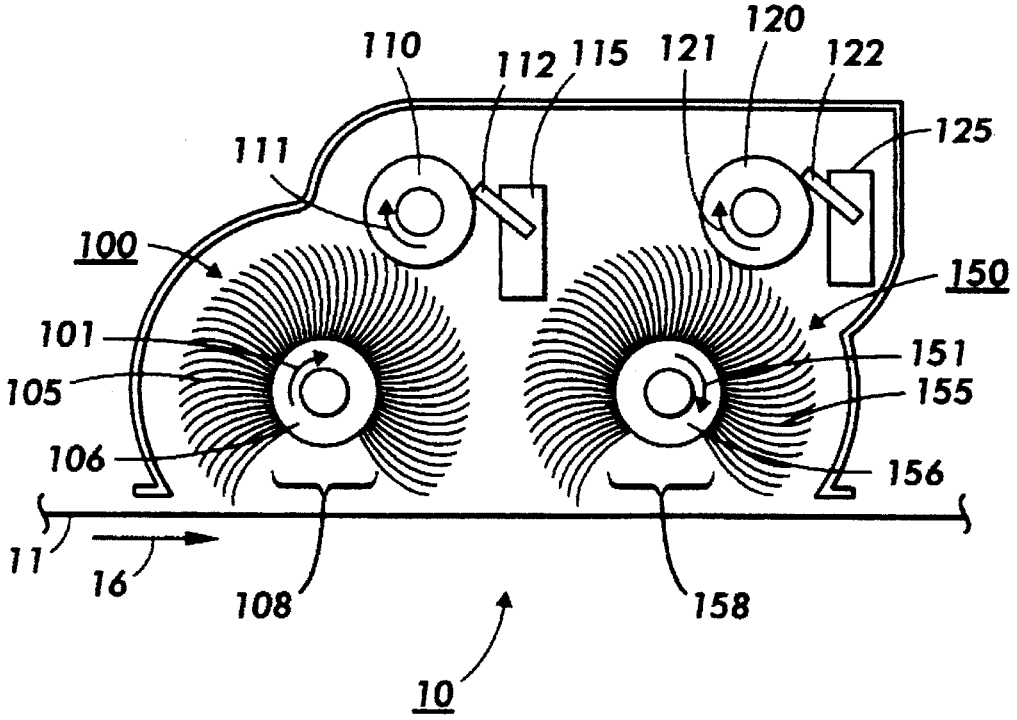
FIG. 1 is a schematic illustration of the present invention at the "home" position.

Reference is now made to FIG. 1, which shows the "home" position of the cleaner brushes in the present invention. The present invention allows cleaning of the photoreceptor surface 11 in an image on image printing system. In the "home" position, the bare segments 108, 158 of the cleaner brushes 100, 150 face the photoreceptor surface 11. One of the cleaner brushes 100 is located upstream from the second cleaner brush 150, in the direction of movement of the photoreceptor 10, shown by the arrow 16. The brushes 100, 150 rotate in the direction of the respective arrows 101, 151. Each brush has a detoning roll 110, 120 to remove residual particles from the cleaner brushes. The detoning rolls 110, 120 rotate in a direction shown by the arrows 111, 121. respectively. Scraper blades 112, 122 remove the particles from the detoning rolls 110, 120 and guide these removed particles into a waste receptacle 115, 125.

In a standard four pass system, each imaging layer is developed and transferred independently, before the cleaner brushes contact the photoreceptor belt (or drum) surface to remove the residual toner. This is normally done by retracting the cleaning brushes and the photoreceptor away from one another during this process.

With continued reference to FIG. 1, fibers 105, 155 on the cleaner brushes 100, 150 are removed or cut away from a segment of the brush core 106, 156 creating the bare segments 108, 158. The bare segments 108, 158 allow disablement of the cleaning operation of the brushes 100, 150 when required. When this bare segment 108, 158 region of the brush faces the photoreceptor surface 11, no contact between the brush fibers 105, 155 and the photoreceptor 10 is made. When the brushes cease rotation such that the bare segments 108, 158 of the brush are positioned opposite the photoreceptor surface 11, a multi-pass image can be built-up in layers on the photoreceptor (e.g. imaging or photoconductive) surface 11 without interference from the brushes 100, 150 (i.e. this eliminates the need to cam the brushes 100, 150 away during development). On the pass where the toner is transferred to paper (or other media), the brushes will once again start rotating or movement to clean the residual particles from the photoreceptor belt (or drum). A stepper motor (not shown) with a "home" sensor can be used to accurately stop the brush with the bare segment 108, 158 positioned facing the image on the photoreceptor 10 and thereby "toggle" to the cleaning function. This procedure is less complicated than a system that requires retraction of the brushes.

In recapitulation, the present invention provides a fiberless segment in the cleaning brush. The cleaner brushes when stopped with the fiberless (or bare) segments facing the imaging surface, allow a multiple pass image to be built up in layers on the surface during development without interference from the cleaner brushes. Once development is complete then the cleaning brushes begin movement (e.g. rotation) to clean the imaging surface with the brush fibers on the remainder of the brush core. The advantage of the present invention is that complex mechanical camming is not required to retract the brushes in order to prevent interference. The brushes are driven, instead by a controlled stepper-motor that will be able to return to the "home" position at any moment. Furthermore, cleaning is not compromised by the present invention.

It is, therefore, apparent that there has been provided in accordance with the present invention, a cleaner brush with a fiberless segment that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for cleaning particles from a surface using a cleaner brush capable of motion having a home position, the home position of the cleaner brush preventing cleaning contact between the cleaner brush and the imaging surface, comprising:

positioning the cleaner brush in the home position to prevent contact between the cleaner brush and the imaging surface during developing without retracting the cleaner brush away from the imaging surface;

developing a multi-layered image on the surface;

transferring the multi-layered image from the surface to a media; and restarting movement of the cleaner brush to remove residual particles from the surface.

2. A method for cleaning particles from a surface using a cleaner brush capable of motion having a home position, the home position of the cleaner brush preventing cleaning contact between the cleaner brush and the imaging surface, comprising:

positioning the cleaner brush in the home position to prevent contact between the cleaner brush and the imaging surface during developing, the step of positioning the cleaner brush in a home position comprises the step of stopping movement of the cleaner brush having a fiberless segment and a fiber segment, the fiberless segment being directly opposed to the surface during developing;

developing a multi-layered image on the surface;

transferring the multi-layered image from the surface to a media; and restarting movement of the cleaner brush to remove residual particles from the surface.

3. A method as recited in claim 2, wherein the restarting step comprises the step of moving the cleaner brush enabling the fiber segment of the cleaner brush to contact the surface to remove the particles therefrom.

4. An apparatus for removing particles from a surface, comprising:

means for developing a multi-layer image on the surface;

means for transferring the multi-layer image from the surface to a media;

means for cleaning residual particles without retracting said cleaning means away from the surface, said cleaning means having a first segment that avoids contact with the surface to prevent removal of the particles from the surface during development of the multi-layer image and a second segment that contacts the surface after transfer of the multi-layer image;

means for positioning said first segment adjacent the surface during development of the multi-layer image on the surface comprising a home position; and means for moving said cleaning means to enable the second segment to remove particles from the surface after transferring the multi-layer image to the media.

5. An apparatus as recited in claim 4, wherein the cleaning means comprises a brush.

6. An apparatus as recited in claim 5, wherein said brush is rotatable.

7. An apparatus for removing particles from a surface, comprising:

means for developing a multi-layer image on the surface;

means for transferring the multi-layer image from the surface to a media;

a rotatable brush for cleaning residual particles having a first segment that avoids contact with the surface to prevent removal of the particles from the surface during development of the multi-layer image and a second segment that contacts the surface after transfer of the multi-layer image, said first segment comprises a fiberless portion of said brush and said second segment having fibers extending radially from a core of said brush for removing particles from the surface;

means for positioning said first segment adjacent the surface during development of the multi-layer image on the surface comprising a home position; and means for moving said rotatable brush to enable the second segment to remove particles from the surface after transferring the multi-layer image to the media.

8. An apparatus as recited in claim 7, wherein said first segment being positioned so that no contact occurs between said brush and the surface and said brush is prevented from rotating from the home position.

9. An apparatus as recited in claim 8, wherein said brush moves rotatably about an axis after transfer of the multi-layer image to remove residual particles from the surface.

* * * * *